US005385531A

United States Patent [19]

Jover

[11] Patent Number: 5,385,531

[45] Date of Patent: Jan. 31, 1995

[54] MASSAGE ROBOT FOR RELAXATION ARMCHAIR

[75] Inventor: Fernando J. Jover, Novelda, Spain

[73] Assignee: Eurokeyton S.A., Alicante, Spain

[21] Appl. No.: 79,055

[22] Filed: Jun. 17, 1993

[30] Foreign Application Priority Data

Jul. 8, 1992 [ES] Spain ..... 9201407

[51] Int. Cl.[6] ..... A47C 3/00; A61H 7/00; A61H 15/00

[52] U.S. Cl. ..... 601/99; 297/284.4; 297/284.3; 297/284.1; 601/116; 601/92; 601/49

[58] Field of Search ..... 297/284.7, 284.4, 284.3, 297/284.1; 128/33, 51, 52, 57, 59-61

[56] References Cited

U.S. PATENT DOCUMENTS

| | | | |
|---|---|---|---|
| 2,258,119 | 10/1941 | Mathe et al. | 297/284.1 |
| 2,756,809 | 7/1956 | Endresen | 297/284.7 |
| 3,880,463 | 4/1975 | Shephard et al. | 297/284.7 |
| 4,422,449 | 12/1983 | Hamabe | 128/44 |
| 4,576,149 | 3/1986 | Otuka et al. | 128/33 |
| 4,722,569 | 2/1988 | Morgenstern et al. | 297/284.7 |
| 4,915,448 | 4/1990 | Morgenstern | 297/284.7 |
| 5,112,106 | 5/1992 | Asbjornsen et al. | 297/284.7 |
| 5,120,109 | 6/1992 | Rangoni | 297/284.3 |
| 5,233,973 | 8/1993 | Gill et al. | 128/33 |

FOREIGN PATENT DOCUMENTS

| | | | |
|---|---|---|---|
| 2345111 | 10/1977 | France | 297/284.1 |
| 1199756 | 7/1970 | United Kingdom | 297/284 |

*Primary Examiner*—Robert A. Hafer
*Assistant Examiner*—Brian E. Hanlon
*Attorney, Agent, or Firm*—Milton S. Gernstein; Marvin N. Benn

[57] ABSTRACT

A massage chair has a back-frame and massaging rollers mounted in the back-frame. The massaging rollers are guided by guide-plates, as the massage rollers reciprocate in the chair back. The guide-plates form an upper back-section, and a lower back-section, with the upper back-section being vertically movable with respect to the lower back-section. The lower back-section is pivotally mounted to the stationary frame, whereby the lower end-section thereof is movable toward and away from the frame, whereby the path of travel of the massage rollers may be adjusted to fit the back of different users of the chair, and for altering the massage.

10 Claims, 6 Drawing Sheets

MASSAGE ROBOT FOR RELAXATION ARMCHAIR

BACKGROUND OF THE INVENTION

The present invention is directed to a massage robot for relaxation chairs, which offers a series of significant benefits to those users who require them. The idea of creating this massage machine with rollers incorporated into the chairback came, on the one hand, from observing the mechanism, its relatively simple construction and robust nature, and on the other hand from noting the possibility of putting the aforesaid mechanism under an upholstery cover, owing, above all, to the fact that its size allows this, and also that it does not require complicated anchorage to a frame, which would complicate its mounting on the standard chassis of a conventional chair. Thus, it is possible to manufacture the chassis without having to make hardly any modifications, or at least only ones of an insignificant nature. The chassis would be manufactured without incorporating any mechanical devices, and only some slight modifications would have to be taken into consideration to allow the massage machine to be placed in a conventional chair back.

During the research period previous to developing this machine of the invention, an in-depth study was completed of some of the most modern and advanced roller massage machines on the market today. Traditionally, importance has only been given to the ergonomics of chairs and armchairs which have interior massage mechanisms, but what is totally and especially new according to the invention is being able to offer a massage robot in which the roller massage machine is ergonomic and able to adapt to any user, including those whose physical characteristics do not conform to the average build, for which previous massage armchairs have been built.

One of the objectives of the invention is to create a massage mechanism which can perform a certain number of functions, and is able to be adapted to the stature and lumbar characteristics of each user, through the possibility of regulating the position of the neck and lumbar sections of the chair. It can be predicted that this machine of the invention will easily surpass its predecessors, especially as far as ergonomics are concerned, something which, as has been stated, has not previously been taken into consideration.

The present project is the result of a series of technical studies carried out during a period of well over a year and a half. This gives the product certain characteristics of quality and usefulnfss which place it ahead of any massage device currently on the market. In theory, it is foreseen that the massage armchair of the invention will be able to incorporate a series of massage functions, but always remembering that, in the short or long term, there is the possibility of adding more functions without having to modify any part of the structure of the armchair. It would be sufficient to simply change the internal programming of the mechanism. The fundamental objective of the present invention has always been to achieve the development of a massage roller mechanism which would be anatomically adaptable to the individual ergonomic needs of each user, especially those related to stature and lumbar shape.

The most modern and advanced roller massage machines in existence today present the user with numerous problems of personal adaptation, given that these machines have always been developed to adapt exclusively to users considered, in stature and other physical characteristics, to be of "average build". On deciding to begin research and all this entails, it was necessary to take into consideration the complete range of products on the present market which could bear some relation to the final product aimed at through this invention. On the one hand, there was carried out a full, thorough and systematic revision of all the available literature on massage techniques of the human body, the fundamental and therapeutic benefits of these . . . etc. In the specific case of the back, which is the part of the body where the mechanics of the chair applies the massage, it must be emphasized that most pains and discomfort felt here are mainly due to habitual bad postures assumed at work, when sitting or walking. This provokes rigidity or tension in back muscles, a rigidity which is the main cause of discomfort. To eliminate back pains, and consequently the discomfort this involves, it is necessary to discover the causes and find a way to counteract them. Thus, the aim of the invention is to, in some way, alleviate muscular tension in the back, by applying a massage which stretches out the muscles in the affected area. This massage can be supplied by the machine of the present invention.

Back pain can be due to various causes:

a) Weakening of the discs;
b) Vertebral arthritis;
c) Minor disorders of the intervertebrae;
d) Lumbago;
e) Dorsal problems;
f) Cervical problems.

As for weakening of the discs (a), this appears around the age of thirty. At thirty years old, a process of aging and decay of the intervertebrae begins and causes discomfort, especially when the back is submitted to a certain level of exertion. Vertebral arthritis (b) is due to the aging process, just as frequent in men as in women. Minor intervertebral disorders (c) are small displacements of the vertebrae, causing local pressure which is very painful. Lumbago (d) is an intermittent pain concentrated in the lower back. It is particularly felt after physical effort, and is made worse by standing or sitting in the same position too long.

There are three types of lumbago which are due to:

Acute lumbago;
Sciatica;
Muscular pains;
Reflex pains;

As for dorsal pains (e) these are back pains in the middle part of the back. They are suffered more by women than men, and are mainly due to the type of work carried out daily by women, such as housewives, work which involves maintaining a certain number of inadvisable positions for a length of time. It is an almost constant, latent pain which becomes worse the longer a person remains seated or standing. It also increases during the day.

Cervical pain (f), or pains concentrated in the upper part of the back, cause discomfort in the form of a more intermittent, diffused type of pain. This is susceptible to climatic changes (of humidity and temperature), and is accompanied by migraines, headaches and earache (a feeling that the ears are blocked or of deafness) and dizziness. One way of counteracting the different back pains that have been described and of alleviating them is by resorting to massage. This plays an indispensable part in the re-education of body movements. Massage is only inadvisable if there is inflammation, as it could make the pain worse.

The massage techniques which have demonstrated their efficacy in alleviating pain in the course of time, are the following.

Smooth rubbing movements of pressure over the painful areas; this produces a soothing, relaxing feeling;

Pressure on a particular spot, a type of massage using continuous pressure maintained for a short time and then eased; this concentrated pressure is recommended in cases of muscular contractions of the spine;

Kneading, which uses lateral or snake-like sliding movements over the body; this type of massage is particularly recommended in cases of contractions of the trunk or the straight muscles of the limbs;

Vibrations, a type of massage which should be applied with a rapid but not very intense at the acupuncture points, in which case it called digitpuncture; this is especially recommended when the aim is to improve circulation in certain areas of the body.

Later, and with reference to the diagrams, the studies done on previous mechanisms will be analyzed, describing the working of a mechanism built into the back an existing massage chair already on the market.

SUMMARY OF THE INVENTION

The ergonomic limitations mentioned in the previous section suggest the necessity, or at least the convenience, of developing the machine of the present invention that is to include in its structure a series of mechanisms to overcome the ergonomic limitations observed in previous models. Thus, it has been found necessary to create an alternative design to the conventional massage chair-backs, the shape of which can be regulated according to the stature of the user and the amount of lumbar support necessary. The present invention is an alternative design to overcome all the ergonomic limitations in existence up to now. This alternative massage chair includes a mechanism capable of adapting the chair to the stature of the user, and a back which can change shape with synchronized movements to adapt perfectly the movement of the rollers to the spine of each user, whatever his stature and lower-back shape—thus adjusting the massages in a very exact way.

In order to adapt the roller mechanism to the different heights of users, a mechanism has been developed to alter the position of the cervical part of the chair back either up or down, following the direction of the massage. The massage robot of the invention has parallel rollers which can move along the chair back, below the upholstery, in a vertical direction. They are mounted on a mobile carriage which moves along the two body-shaped frames fixed to the side of the chassis. The body-shaped frames shift in a synchronized fashion by means of a spindle worked by a reduction-motor, the nut of which is fixed to a bridge which shifts the cervical section, to which it is connected. Consequently, the cervical section moves at infinitesimal intervals up or down, depending on whether the motor is made to go in one direction or another—and so adapts to the user whose lumbar regions do not correspond to the average.

To complete the ergonomic correction mechanism that this invention incorporates, an adjusting mechanism for the lumbar section of the chair has also been inserted, in order to adapt it to the user whose lumbar regions do not correspond to the average. The lumbar section of the chair is joined from the top to the chassis, and is able to move from the bottom making an arch of circumference, whose longitude coincides with the difference in radius of a "snail-shaped lever" at the beginning and the end of its angular course. The two body-shaped frames rest on the lever via some support rollers, and the axle of the lever is connected to an independent reduction-motor. This layout causes the lumbar section to make a slight rotation about it axle and consequently an almost horizontal movement of the lower part of the chairback forwards or backwards. By means of the mechanism of the invention, it is possible to adapt the lumbar curve of the message machine to the lumbar curve of the back of any user and so also achieve an ergonomic message in the lumbar regions.

To make easier the understanding of the characteristics of the invention and forming an integral part of this report, a series of detailed illustrative diagrams have been included.

BRIEF DESCRIPTION OF THE DRAWINGS

The invention will be more readily understood with reference to the accompanying drawing, wherein.

DETAILED DESCRIPTION OF THE INVENTION

Figure 1:
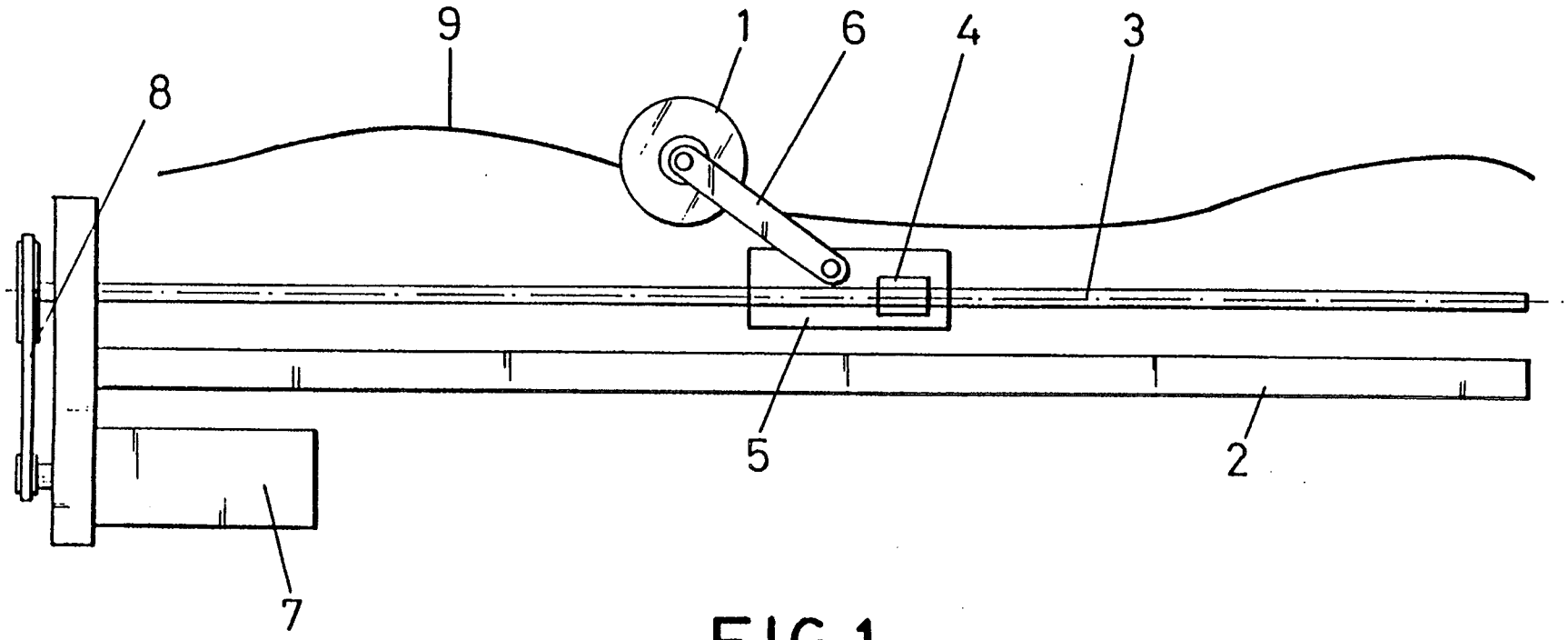
FIG. 1 is a vertical cross-section view showing the movement of the rollers of the message robot for relaxation armchair.

Referring to the enumeration used in the diagrams, one can see that the massage robot for relaxation armchairs has significant benefits over existing massage armchairs. In effect, the main function of this mechanism is the vertical movement of parallel rollers 1 along the interior of the chairback 9. This movement is initiated by turning rod 3. This rod passes through a nut, which absorbs the turning movement or rod 3, and only allows the rod to move vertically around its axis. This nut is, in turn, situated inside a bridge support 5, which carries a mobile carriage, which moves with the rollers to produce the massage. The rod is attached to a pulley which is worked by the exit pulley of a small electric reduction-motor, by means of a belt 8. It must be emphasized that carriage 6 on which the rollers operate, follows throughout its movement along the rod 3 the line of the shaped framework which is firmly fixed to the chassis of the mechanism, as can be seen in diagram 1. As this chairback 9 is, at present, rigid, it means the effect of the massage is always the same, the rollers exert an equal amount of pressure on all parts of the back. In other words, the rollers 1, which perform the back massage, always move in the same direction along the rod 3, and follow the body-shaped frame 9 fixed to the chassis of the chair 2. From the above, it is reasonable to believe that if the rollers always follow the same course they will not be appropriate for all users, and will not take into account the possible differences from average height of the different users. It has also been found that the massage the user receives in the chair under study depends on the angle of the chairback. That is to say, that when the chairback is in a more horizontal position, then more weight rests on the chairback, and so the rollers exert more pressure on the user's back. From this it can be deduced that in any given fixed position, the intensity of the massage is different for each person depending on his or her stature and lumbar curve. Thus, it can be concluded that there are a series of limitations or ergonomic disadvantages when using the conventional massage chair:

1) The rollers always follow the same course without any possibility of adjustment to the individual requirements of each user; consequently, the massage has varying degrees of efficacy for each user, and can only be used by people of average stature and dorsal curve;
2) On the other hand, it can also be appreciated that the intensity of the massage (which is relative to the amount of weight applied to the rollers) will be greater or smaller depending on the differences which exist between the standard shape and the shape of the user, being too intense in some areas and insufficient in others.

Figure 2:
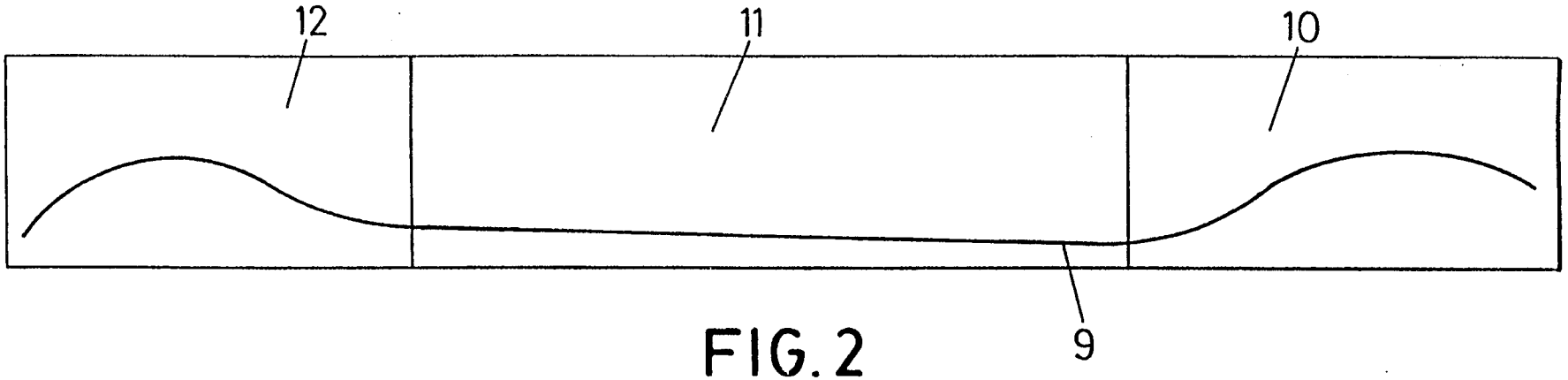
FIG. 2 is a view of the shape of the chairback of conventional mechanisms which can only be adapted to people of an average shape; the chairback is divided into three distinctive zones: lumbar, dorsal and cervical.

Now paying special attention to FIG. 2, one can see that chairback 9, which influences the movement of roller 1, is divided into three distinct areas: Lumbar zone 10, which corresponds to the lowest part of the back; dorsal zone 11, which corresponds to the middle part of the back; and the cervical zone 12, which corresponds to the upper part of the back. The chairback 9, used by conventional mechanisms, is only suitable for people of average build, that is to say those who are 1.75 meters tall. Given the way in which these zones vary in each user, it is to be estimated that the size of each of these zones of the back is in proportion to the user's overall stature. That is to say, that a user whose stature is a certain percentage larger than average will have each zone of the back bigger than the areas into which the standard chairback is divided. On other hand, if the stature of the user is less than average, then the dorsal zones will be the same percentage smaller. Let us suppose, for example, that the conventional armchair, object of this study, has a chairback 9 which can adapt exclusively to users with an average stature, whose spinal curve and heights are average, that is to say, about 1.75 m.

Figure 3:
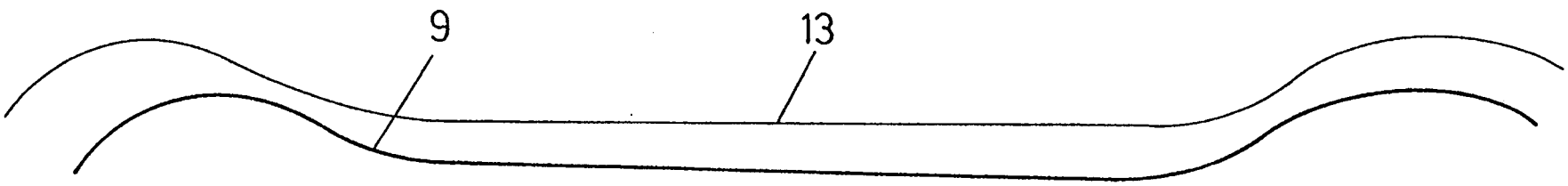
FIG. 3 shows the curve the message rollers follow along the chair back for an average-sized user, compared to the body shape of a user whose size is 8% larger than average (1.90 m)
Figure 4:
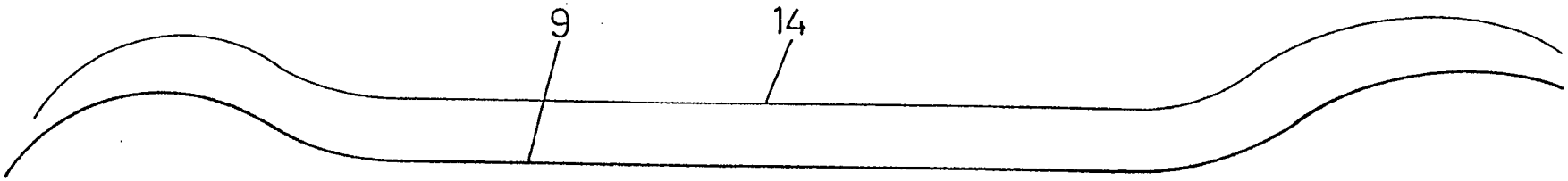
FIG. 4 is similar to FIG. 3, but comparing the curve of chairback with the shape of a user who is 9% smaller than average (1.60 m)

In FIGS. 3 and 4, one can see diagrams which show how the massage works for people of a different size from that considered average. Thus, in FIG. 3, one can see, referring to 13, the spinal curve of a user whose height is 8% greater than average, that is to say 1.90 m. The cervical massage begins earlier in this case, and does not reach the end of the zone, while in the lumbar zone, it would be a little more intense. In FIG. 4, one can see the effects of the massage performed on a user whose height is 9% smaller than average, that is to say about 1.60 m. In this case, the spinal curve of the user is referred to as 14, and it can be seen that in the cervical zone the massage is slight, whereas in lumbar zone it is slightly more intense. Furthermore, the roller starts to push the user's head.

Figure 5:
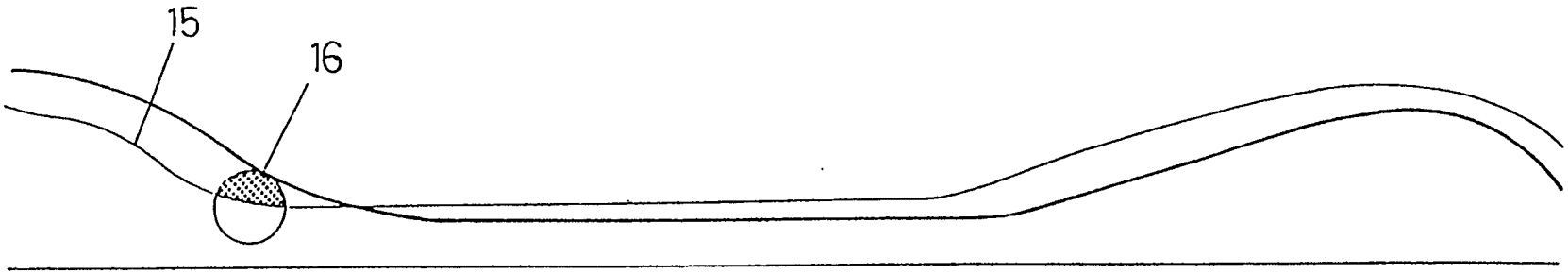
FIG. 5 shows the existing relationship between the intensity of the massage applied with a conventional relaxation armchair, depending on the position of the chairback and dorsal curvature of the user.

The operational and constructive solutions suggested to solve the ergonomic problem of adapting each user are shown in FIG. 5, where the user's shape is referred to as 15. Knowing the relationship that exists between the intensity of the massage applied by the conventional armchair with how much the chairback is reclined, is obviously a very complex task from a theoretical point of view. This intensity coincides with the action of the roller on the surface of the chairback. To understand this, it is necessary to know the distribution of pressure on the chairback, and to know how much weight falls on each point of the roller's path.

It is well known that the intensity of the massage depends on the difference which exists between the movement of the rollers (which corresponds to fixed frame 9) and the dorsal curve of the user (reference number 15); this may be called the "penetration" by the rollers in certain parts of the back. Thus in the cervical zone a heightened intensity of massage is produced with a penetration marked in the shaded area of the roller and referred to as 16. In the lumbar zone a low intensity massage is performed.

Figure 6:
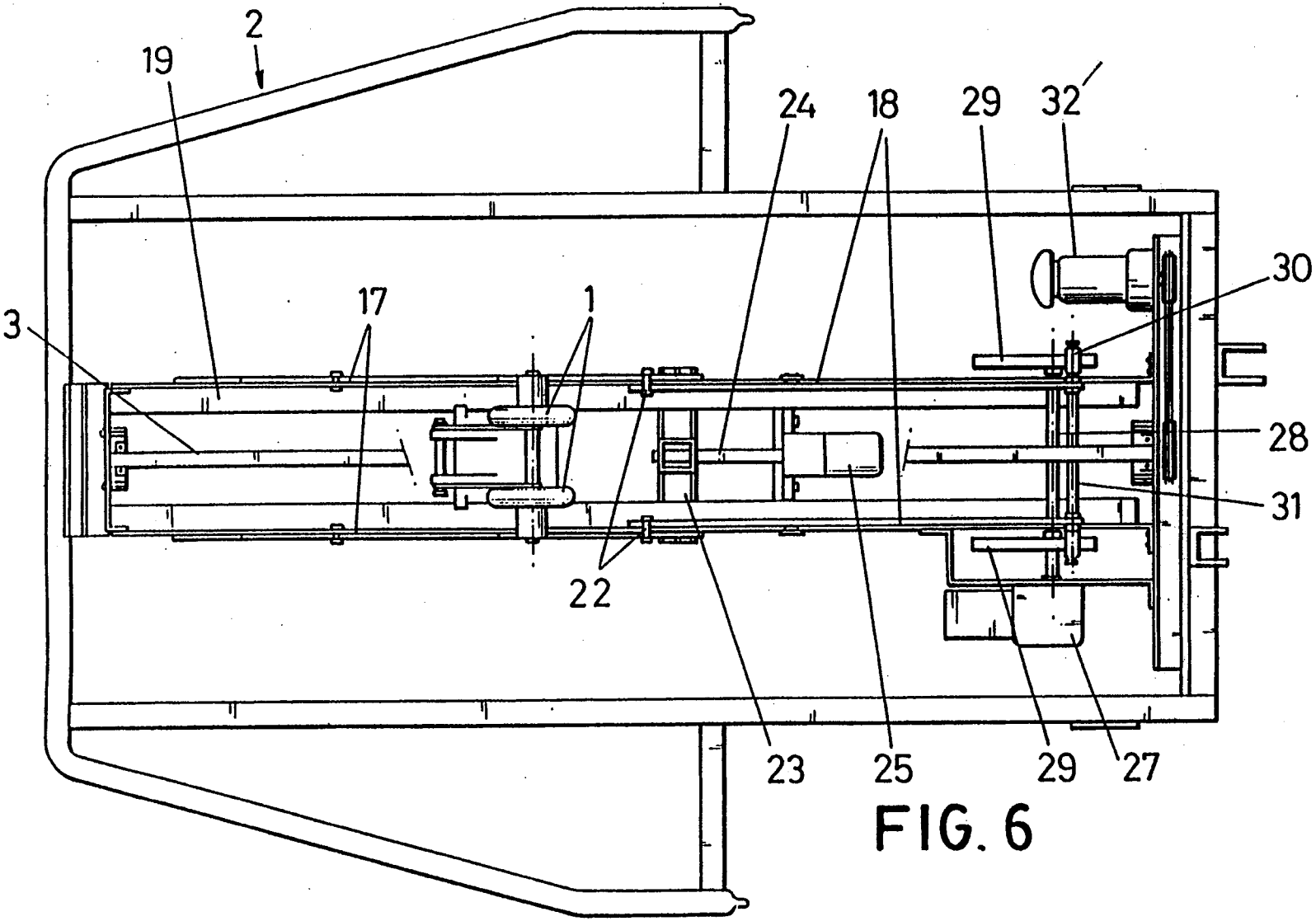
FIG. 6 is a view of the massage robot for relaxation armchairs of the invention.
Figure 7:
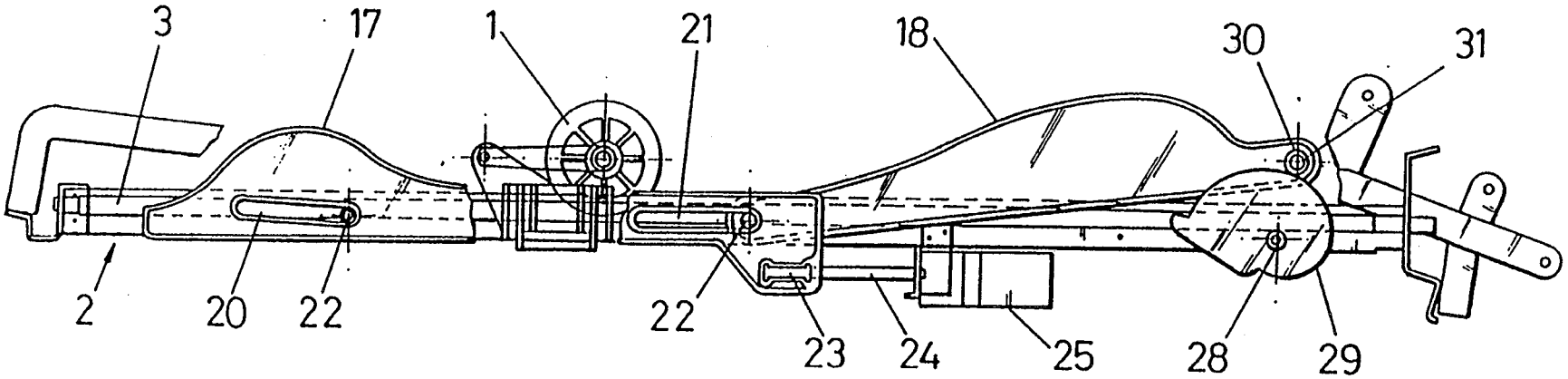
FIG. 7 is a vertical cross-section of what is shown in FIG. 6.
Figure 8:
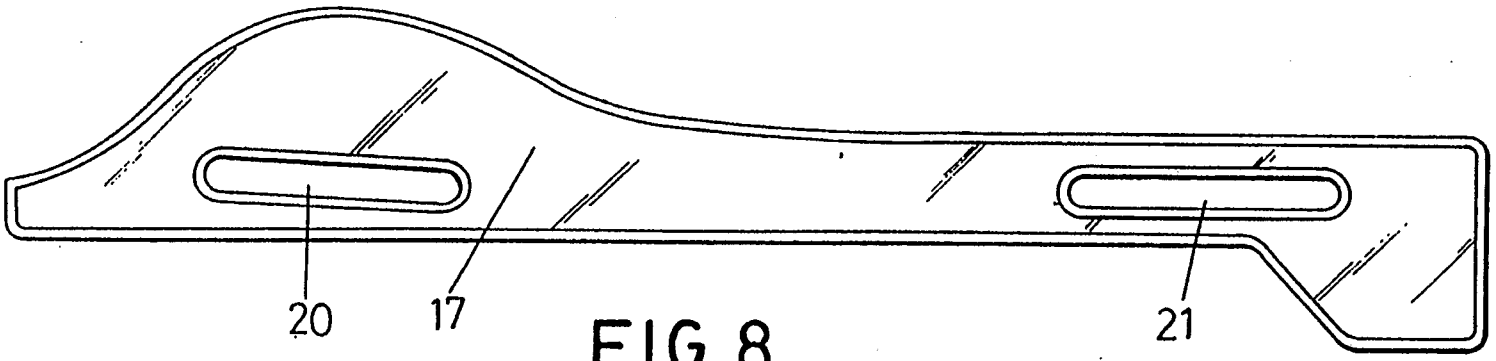
FIG. 8 is a cross-sectional view of one of the lateral body-shaped plates which fits to the human cervical shape for the movement of the massage rollers.

Taking into account the above and with the aim of adapting the roller massage mechanism to the varying heights of different users, in accordance with the invention and with reference to FIGS. 6–9, one can see how the massage robot for relaxation chairs includes body-shaped plate-protrusions or bracket guide-plates 17, 18, the former corresponding to the cervical area and the latter to the lumbar area, and made up of two plates which are situated on both sides of the central part of the chassis 19. The cervical curve 17, as seen in FIG. 8, is movable in a vertical direction, as it includes elongated grooves 20, 21 in the front and back into which pins or small protrusions of the chassis slide. These pins are actually pivot pins 22 that pivotally mount the upper ends of the lower plates 18 so that the lower plates may be pivoted outwardly from the bottom thereof, as described hereinbelow. The two upper plates 17 are solidly joined together by the driving carriage 23, in the middle of which there is a nut. This cooperates with a rod 24 mechanism which moves the driving carriage 23 of the cervical section 17. The rod 24 is activated by a reduction-motor 25, as can be clearly seen in FIGS. 6 and 7, which motor 25 and rod 24 are affixed to the main, stationary frame or chassis 19. Consequently, depending on the direction of rotation of the reduction-motor 25, it is possible to adjust the cervical part of the chair back 17 to suit the anatomy of the user, with the limits of vertical movement of the plates 17 being the abutment of the pins 22 against the ends of the slots 20, 21. Since the plates 17 are mounted for vertical movement with respect to the lower plates 18, the upper plates 17 may be adjusted to the particular height of a person sitting in the chair.

Figure 9:
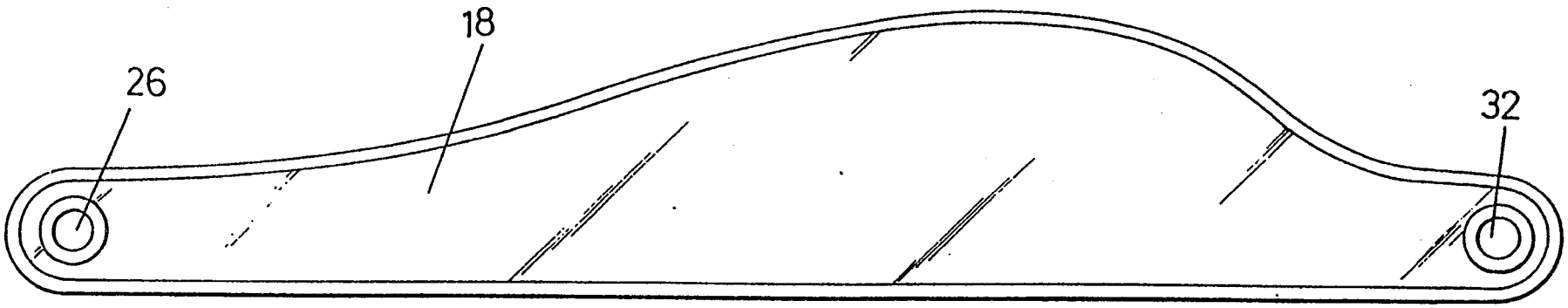
FIG. 9 is a cross-sectional view of one of the lateral plates which fits to the shape of the lumbar regions, thus allowing the rollers to follow the curve of the user's body.

The lumbar section of the chair back consists of two lower plates 18 situated on both sides of the chassis (see FIG. 6), each with the design shown in FIG. 9, which can be modified to fit the lumbar shape of the user of the chair. As can be seen in FIGS. 6 and 7, the lumbar section is joined at the top (on the left of FIG. 7) to the stationary chassis 2, or more precisely, the pivot pin 22 passes through opening 26 at the upper end of each plate 18, and then into a respective slot 21 of the cervical section, as described above. The angular movement of the lumbar section is achieved by means of the independent reduction-motor 27 to whose axis 28, running horizontally to chassis 2, are attached the "snail-shaped cams" 29. The rollers 30, which are at the ends of the cross axle 31, rest on these cams. Axle 31 passes through the openings 32 at the lower ends of the lumbar section plates 18. So, by turning the "snail-shaped lever" 29, one can increase or decrease the pivotal movement of the lower plates 18 about their pivot pins 22, whereby the lower ends of the plates 18 will be drawn closer or pushed farther away from the main chassis in order to adjust the massage at the lower portion of the back, and as the upper part of the lumbar section 18 is fixed it will make a slight turning movement in order to adapt to the lumbar curve of the massage mechanism to that of the user. Reference 32' in FIG. 6 shows the reduction motor which initiates the turning of the main spindle 3 in order to move the massage rollers 1, as is conventionally done.

While a specific embodiment of the invention has been shown and described, it is to be understood that numerous changes and modifications may be made therein without departing from the scope, spirit and intent of the invention as set forth in the appended claims.

What I claim is:

1. In a massage chair comprising a stationary chassis having a back-frame and massaging means mounted in said back-frame, said massaging means comprising bracket guide-means for guiding massage roller means, and massage roller means for providing a massage to a back of a person seated in the chair, said massage roller means being guided along said bracket guide-means, and means for translating said massage roller means along said bracket guide-means so that said bracket guide-means impart the designed path of travel to said massage roller means, the improvement comprising:

said bracket guide-means being adjustable for selectively changing said path of travel of said massage roller means to fit the back of different users of the chair and for changing the massage;

said bracket guide-means comprising an upper back-section and a lower back-section, said upper back-section being vertically movable with respect to said lower back-section; and means for mounting said upper back-section for vertical movement with respect to said lower back-section.

2. The massage chair according to claim 1, wherein said lower back-section comprises an upper end-section pivotally mounted to a portion of said chassis, and a lower end-section movable toward and away from said back-frame, and means for pivotally mounting said upper end-section of said lower back-section to said portion of said chassis.

3. The massage chair according to claim 2, wherein each of said upper back-section and said lower back-section comprises a pair of spaced-apart guide-plates, said means for mounting said upper back-section for vertical movement with respect to said lower back-section comprises a slot formed in the lower portion of each said guide-plate of said upper back-section, said means for pivotally mounting said upper end-section of said lower back-section to said portion of said chassis comprising a pivot shaft passing through each said slot and through said portion of said chassis, whereby said relative vertical movement is achieved; said pivot shaft sliding in said slots and limiting the upward and downward relative movement of said upper back-section by abutting contact against the lower and upper ends of said slots.

4. The massage chair according to claim 2, further comprising a first motor means for vertically moving said upper back-section relative to said lower back-section, and a second motor means for pivoting said lower back-section about said means for pivotally mounting said upper section.

5. The massage chair according to claim 4, wherein said second motor means comprises a motor, a drive connection, and rotatable camming means operatively coupled to said drive connection; said lower end-section of said lower back-section having a cam-follower means for cooperation with said camming means, whereby, upon rotation of said camming means, said lower end-section of said lower back-section is moved farther away or closer toward said stationary chassis.

6. A method of adjusting the path of movement of massage rollers of a massage chair, which massage chair comprises a stationary chassis having a back-frame, and massaging means mounted in the back-frame for providing a massage to a person seated in the chair, the massaging means comprising massage rollers, and bracket guide-means for guiding the massage rollers, the bracket guide-means comprising an upper back-section, and a lower back-section, the lower back-section having an upper end-portion rotatably mounted with respect to the lower end-section of the upper back-section, said method comprising:

(a) vertically moving, in at least one of the upward direction and downward direction, the upper back-section relative to the lower back-section in order to change the total length of the path of travel of the massage rollers;

(b) rotating the lower back-section relative to the upper back-section in order to adjust the distance that the lower end-section of the lower back-section is spaced outwardly from the chassis, whereby the amount of penetration of the massage rollers against the lower part of the back of a person sitting in the chair during a massage may be altered; and (c) after said step (b), translating the roller means along the upper and lower back-sections for massaging the back of the person sitting in the chair.

7. The method of adjusting the path of movement of massage rollers of a massage chair according to claim 6, wherein said step (a) comprises:

(d) vertically and downwardly moving the upper back-section relative to the lower back-section in order to change the total length of the path of travel of the massage rollers, when a person of less than average height is sitting in the chair.

8. The method of adjusting the path of movement of massage rollers of a massage chair according to claim 6, wherein said step (a) comprises:

(d) vertically and upwardly moving the upper back-section relative to the lower back-section in order to change the total length of the path of travel of the massage rollers, when a person of greater than average height is sitting in the chair.

9. The method of adjusting the path of movement of massage rollers of a massage chair according to claim 6, wherein said step (b) comprises:

(d) rotating the lower back-section relative to the upper back-section in order to increase the distance that the lower end-section of the lower back-section is spaced outwardly from the chassis, whereby the amount of penetration of the massage rollers against the lower part of the back of a person sitting in the chair during a massage is increased.

10. The method of adjusting the path of movement of massage rollers of a massage chair according to claim 6, wherein said step (b) comprises:

(d) rotating the lower back-section relative to the upper back-section in order to decrease the distance that the lower end-section of the lower back-section is spaced outwardly from the chassis, whereby the amount of penetration of the massage rollers against the lower part of the back of a person sitting in the chair during a massage is decreased.

* * * * *